US009073613B2

(12) United States Patent
Berman et al.

(10) Patent No.: US 9,073,613 B2
(45) **Date of Patent: *Jul. 7, 2015**

(54) PROTECTIVE BOAT RUB RAIL SYSTEM

(71) Applicants: Ronald M. Berman, Port Orange, FL (US); Susan A. Smith, Farmington, IL (US)

(72) Inventors: Ronald M. Berman, Port Orange, FL (US); Susan A. Smith, Farmington, IL (US); James H. Moses, Liverpool, TX (US)

(73) Assignee: Boston Whaler, Inc., Edgewater, FL (US)

( * ) Notice: Subject to any disclaimer, the term of this patent is extended or adjusted under 35 U.S.C. 154(b) by 35 days.

This patent is subject to a terminal disclaimer.

(21) Appl. No.: 14/057,837

(22) Filed: Oct. 18, 2013

(65) Prior Publication Data

US 2014/0048005 A1 Feb. 20, 2014

Related U.S. Application Data

(63) Continuation of application No. 13/205,137, filed on Aug. 8, 2011, now Pat. No. 8,567,333.

(51) Int. Cl.
*B63B 59/02* (2006.01)

(52) U.S. Cl.
CPC ..... *B63B 59/02* (2013.01); *Y10T 428/24008* (2015.01); *Y10T 428/24017* (2015.01)

(58) Field of Classification Search
CPC ..... B63B 59/02
USPC ..... 114/219; 405/211, 212, 215, 219; 428/99, 100
See application file for complete search history.

(56) References Cited

U.S. PATENT DOCUMENTS

| | | | | |
|---|---|---|---|---|
| 2,959,146 | A | 11/1960 | Erkert | |
| 3,109,405 | A | 11/1963 | Nusinoff | |
| 4,277,526 | A | 7/1981 | Jackson | |
| 4,946,727 | A | 8/1990 | Kessler | |
| 5,149,569 | A | 9/1992 | McCue | |
| RE35,971 | E | 11/1998 | Kessler | |
| 6,988,457 | B2 | 1/2006 | Tsai | |
| 7,430,978 | B2 | 10/2008 | Rezzonico | |
| 7,517,001 | B1 | 4/2009 | Goldbaum | |
| 8,567,333 | B2 * | 10/2013 | Berman et al. | 114/219 |
| 2004/0200397 | A1 | 10/2004 | Klein | |

* cited by examiner

*Primary Examiner* — Lars A Olson

(74) *Attorney, Agent, or Firm* — Malin Haley DiMaggio & Bowen, P.A.

(57) ABSTRACT

A rub rail system for a vessel including a rigid track extrusion attached to a vessel, a resilient flexible fender extrusion, and a shock absorbing inner core. The inner core is disposed in the fender extrusion and the core is substantially softer than the fender extrusion. The fender extrusion is configured to matingly engage the track extrusion. The fender extrusion has an upper barb engaging an upper receiving cavity of the track extrusion and a lower barb engaging a lower receiving cavity of the track extrusion. The track extrusion has an upper tang engaging an upper recess of the fender extrusion and a lower tang engaging a lower recess of the fender extrusion. The track extrusion also includes an upper lip configured to engage a top portion of the perimeter of the vessel and a lower lip configured to engage a lower portion of the perimeter of the vessel.

15 Claims, 8 Drawing Sheets

PROTECTIVE BOAT RUB RAIL SYSTEM

CROSS REFERENCE TO RELATED APPLICATIONS

This application is a continuation of U.S. patent application Ser. No. 13/205,137 filed on Aug. 8, 2011.

STATEMENT REGARDING FEDERALLY SPONSORED RESEARCH OR DEVELOPMENT

N/A

BACKGROUND OF THE INVENTION

1. Field of the Invention

The present invention generally relates to marine vessels and more particularly to a protective rub rail system for marine vessels.

2. Description of Related Art

Many marine vessels incorporate a variety of systems and devices for protecting the perimeter of the boat from damage caused by contact with other boats, docks, or other structures. These protecting devices often function to prevent damage to another boat that the protected boat might encounter. Some exemplary protection systems and devices known in the art include cast urethane fenders, rigid and semi-rigid rub rails, soft hybrid collars, shaped closed-cell foam systems, and rigid hull inflatable boats.

Cast urethane fenders utilize a urethane absorbing material that is cast in molds to create segments of a protection device that can be attached to a boat. These designs require custom molded shapes to fit around corners and other curvatures of a given boat hull. Additionally, these designs require the subject boat hull to be pre-formed or molded with large flat sections to accept the fender segments. Because each segment must be custom made and individually cast, cast urethane fenders can be quite costly to manufacture. Installation is also costly because the fenders must be individually glued to the boat hull. Repair is also quite costly and difficult, because a damaged segment needs to be replaced in its entirety, which requires the removal and re-application of the attachment glue.

Rigid and semi rigid rub rails are very common in boat design and construction. These systems typically consist of a combination of extruded shapes and provide perimeter protection for the vessel it is secured to. Rigid/semi-rigid rail systems do not provide an energy absorbing characteristic and some configurations can easily damage another boat or structure that it happens to contact. While they are lower cost compared to alternatives, the rigid/semi-rigid structure does not have desirable shock absorbing and wear characteristics.

Soft hybrid collars are generally large tubular segments that are received by molded cavities along the perimeter of the boat. These collars are expensive to manufacture and install and are not easily retrofitted to an existing vessel without significant modifications to the hull structure. Moreover, these collars have generally been relegated to government, law enforcement, and commercial applications because they are not aesthetically pleasing in comparison to other available protective devices/systems.

Shaped closed-cell foam systems provide a somewhat softer, energy absorbing vessel fender system as compared to rigid systems or cast urethane fenders. These fenders comprise sections of closed cell foam glued to the perimeter of a boat. While retrofitting is possible, these systems require the vessel to have hull features molded to accept the foam fenders. Although effective for protection and shock absorption, cell foam fenders are unattractive and subject to discoloration and damage over time and generally are not as wear-resistant as other devices.

Rigid Hull Inflatable Boats (RHIB) have become a popular means to provide a soft protective collar or fender for a boat. RHIB vessels have an inflatable hull portion integrated into a rigid lower hull. Such a design significantly compromises interior space due to the relatively large size of the inflatable tubing used. Additionally, the construction of the inflatable tubes and the installation are expensive to manufacture and labor intensive to install. Further, RHIBs can be difficult to repair and, if damaged or punctured, the vessel's seaworthiness can be severely compromised. RHIB's also do not provide any logical way to retrofit an existing boat to have an energy absorbing fendering system boat, save replacing the entire hull, which is simply not practical.

Several variations of the above-described protection devices and systems have been the subject of patent applications and issued patents. For example, U.S. Patent Application 2004/0200397 to Klein discloses a rub strip for boats, which includes a base portion with a longitudinally extended recess groove, into which a shock absorbing insert is placed. The insert can be made of polyvinyl chloride plastic, and snaps into the groove, also functioning to cover the fasteners fixing the system to the hull. The outer surface of the insert is also designed to receive a stainless steel trim strip, which is "crosshead extruded" with the plastic section of the insert. Once the insert is in place within the base portion, an internal channel is created, which allows the insert to flex with respect to the groove U.S. Pat. No. 7,517,001 to Goldbaum illustrates a protective trim system for vehicles to protect against damage to the doors, in which the trim elements include and outer shell which has a conformable surface for attachment to vehicle body, along with a convex wall affixed to the outer edges of the unit. The outer shell defines an interior void that is filled with an energy absorbing foam.

U.S. Pat. No. 7,430,978 to Rezzonic describes various designs for boat fenders which incorporate an "internal conduit". An internal H-shaped bracket section is fixed to the edge of the boat, an external section is adapted to engage the bracket section and absorb impact shock. The external sections includes an internal conduit design with is coupled to a complimentary shaped outwardly extending H-shaped bracket section.

Although the prior art provides some solutions to existing problems, none provide a solution for the need for an energy absorbing rub rail or fender system that can be easily affixed to the perimeter of a vessel using common hand tools and that is easily adapted to a variety of vessel shapes and structural features. Moreover, there is a need for a rub rail system that incorporates the benefits of a resilient exterior fender with a softer shock absorption interior to provide exceptional wear resistances and impact resistance. Additionally, there is a need for a modular rub rail system having these benefits while also being easier to replace and repair as needed.

It is, therefore, to the effective resolution of the aforementioned problems and shortcomings of the prior art that the present invention is directed. However, in view of the rub rails and other vessel protection systems in existence at the time of the present invention, it was not obvious to those persons of ordinary skill in the pertinent art as to how the identified needs could be fulfilled in an advantageous manner.

SUMMARY OF THE INVENTION

The present invention describes a protective rub rail system for vessels providing optimal wear resistance and shock absorption. The rub rail system includes a rigid track extrusion configured to attach to the perimeter of a vessel and a resilient flexible fender extrusion having a softer shock absorbing inner core.

The fender extrusion is configured to matingly and removeably engage the track extrusion. Accordingly, in some embodiments, the fender extrusion has an upper barb and a lower barb, where the upper barb engages an upper receiving cavity of the track extrusion and the lower barb engages a lower receiving cavity of the track extrusion. Further, in some embodiments, the track extrusion has an upper tang and a lower tang, wherein the upper tang engages an upper recess of the fender extrusion and the lower tang engages a lower recess of the fender extrusion.

The track extrusion includes an upper lip and a lower lip, wherein the upper lip is configured to engage a top portion of the perimeter of the vessel and the lower lip is configured to engage a lower portion of the perimeter of the vessel. In some embodiments, the lower lip has a square cross-section providing enhanced stability and resistance to rotation. The fender extrusion includes a lower flange which engages the lower lip of the track extrusion. In some embodiments, the fender extrusion may also include an upper flange having a hook-shaped end that engages the tip of the upper lip of the track extrusion, however the upper flange may be eliminated in other embodiments to prevent buckling of the fender in certain installations. The track extrusion is secured to the perimeter of the vessel by one or more fasteners provided through the track extrusion. Additionally, an adhesive sealant may be applied between the vessel and the track extrusion to provide additional strength to the attachment, while also providing a water-tight seal.

In some embodiments, the rigid track extrusion is comprised of a plastic such as polyvinyl chloride (PVC) having a hardness of at least 50 durometer on the D-type scale, although other rigid and resilient materials may be equally suited. As noted, the fender extrusion is preferably comprised of a material that is substantially harder than its softer inner core. This arrangement allows the inner core to absorb the majority of the shock from an impact, while the harder fender extrusion provides wear resistance and resiliency to repeated blows over time. In some embodiments, the fender extrusion and the inner core are comprised of a thermoplastic elastomer having differing hardness ratings. In some cases, the fender extrusion and inner core each has a hardness between 5 and 98 durometer on the A-type scale, but the inner core has a lower hardness than the fender extrusion.

Accordingly, it is an object of the present invention to provide a rub rail system for vessels that provides optimal wear resistance and shock absorption while reducing or eliminating the damage caused to other structures after impact with the rub rail.

It is another object of the present invention to provide a rub rail system that includes a flexible but resilient fender extrusion having a softer inner core in order to provide optimal wear resistance and superior shock and impact absorption.

It is another object of the present invention to provide a rub rail system that is cost-effective to manufacture and that is easy to install on vessels having a variety of configurations and structural profiles.

It is yet another object of the present invention to provide a rub rail system that provides a track extrusion matingly and removeably engaged with a fender extrusion such that the fender extrusion can be attached and removed with common tools or fasteners, allowing for easier repair and replacement of the system.

In accordance with these and other objects which will become apparent hereinafter, the instant invention will now be described with particular reference to the accompanying drawings.

DETAILED DESCRIPTION

Figure 1:
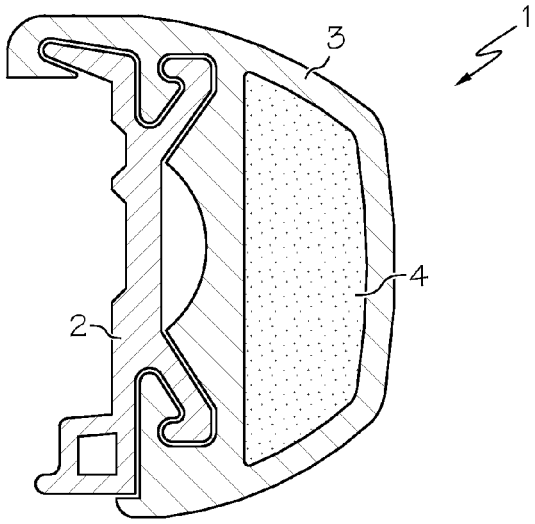
FIG. 1 is a cross-sectional view of the protective rub rail system of the present invention.

With reference to FIG. 1, shown is a cross-section of one embodiment of the rub rail system 1 of the present invention comprising a rub rail track extrusion 2, a rub rail fender extrusion 3, and inner core 4. In some embodiments, track 2 and fender 3 are extruded members that can be extruded to any length desired, depending on the application. Track 2 is configured to be secured to the perimeter of a vessel wherein fender 3 is adapted to removeably and matingly engage track 2. Inner core 4 is disposed within a channel of fender 3, as discussed in greater detail below.

In some embodiments, track 2 is comprised of a rigid non-deformable material such as metal or hardened plastic. In some embodiments, fender 3 is comprised of a resilient, yet flexible material that resists abrasion and impact damage while also preventing damage or abrasion to another vessel or structure that the fender may contact or collide with. It is appreciated that inner core 4 comprises an energy absorbing material that is substantially softer than the material of fender 3, such that fender 3 can transfer impact to inner core 4, which can better absorb impact. The materials used for fender 3 and core 4 will be discussed in greater detail below.

Figure 2:
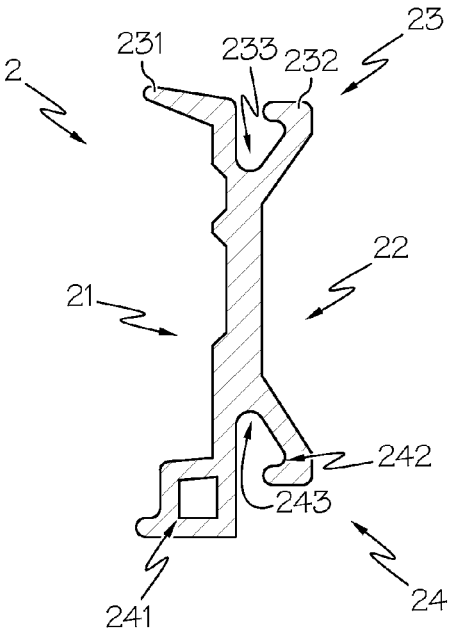
FIG. 2 is a cross-sectional view of the rub rail track of the present invention.

FIG. 2 is an isolated view of the cross-section of one embodiment of track 2 having a vessel side 21 and a fender side 22. Shown also is upper section 23 and a lower section 24, each having a bifurcated or two-pronged configuration. Upper section 23 includes an upper lip 231 and an upper tang 232 which delimit an upper receiving cavity 233. In some embodiments, upper lip 231 extends rearward away from vessel side 21 and upper tang 232 extends substantially upward. Lower section 24 includes a lower lip 241, a lower tang 242 which delimit a lower receiving cavity 243. In some embodiments, lower lip 241 has a square cross-section such that, in its extruded form, the lower lip 241 is a square-tube, providing stability, strength, and rotational resistence for the bottom of track 2. Additionally, in some embodiments, lower tang 242 faces substantially downward.

Figure 3:
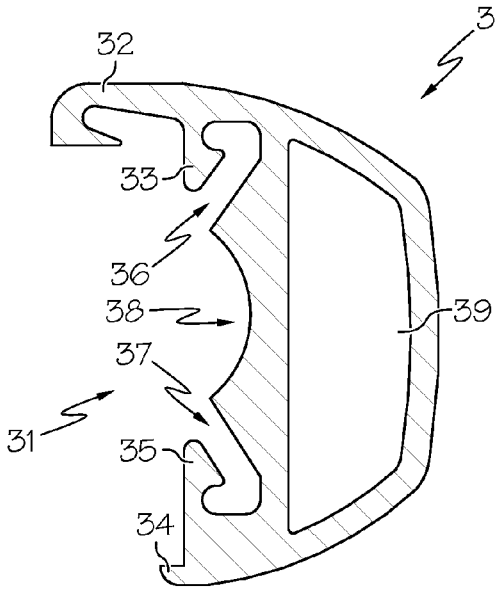
FIG. 3 is a cross-sectional view of the rub rail fender of the present invention.

FIG. 3 is an isolated view of the cross-section of one embodiment of fender 3. The track side 31 of fender 3 is configured to mate the fender side 22 of track 2. Fender 3 comprises an upper flange 32, an upper barb 33, a lower flange 34, and a lower barb 35. In some embodiments, upper flange 32 extends rearward, terminating with a hook-like or curved end. Lower flange 34 is substantially shorter than upper flange 32, defining a short protrusion extending rearward from lower barb 35. It is appreciated that, in some embodiments, the upper barb 33 extends substantially downward and the lower barb 35 extends substantially upward. Fender 3 also includes an upper recess 36 and lower recess 37, each delimited by the upper barb 33 and lower barb 35, respectively, which engage track 2 as described in detail below. Also shown is curved recess 38 and channel 39, which channel receives and is filled with inner core 4.

Figure 4:
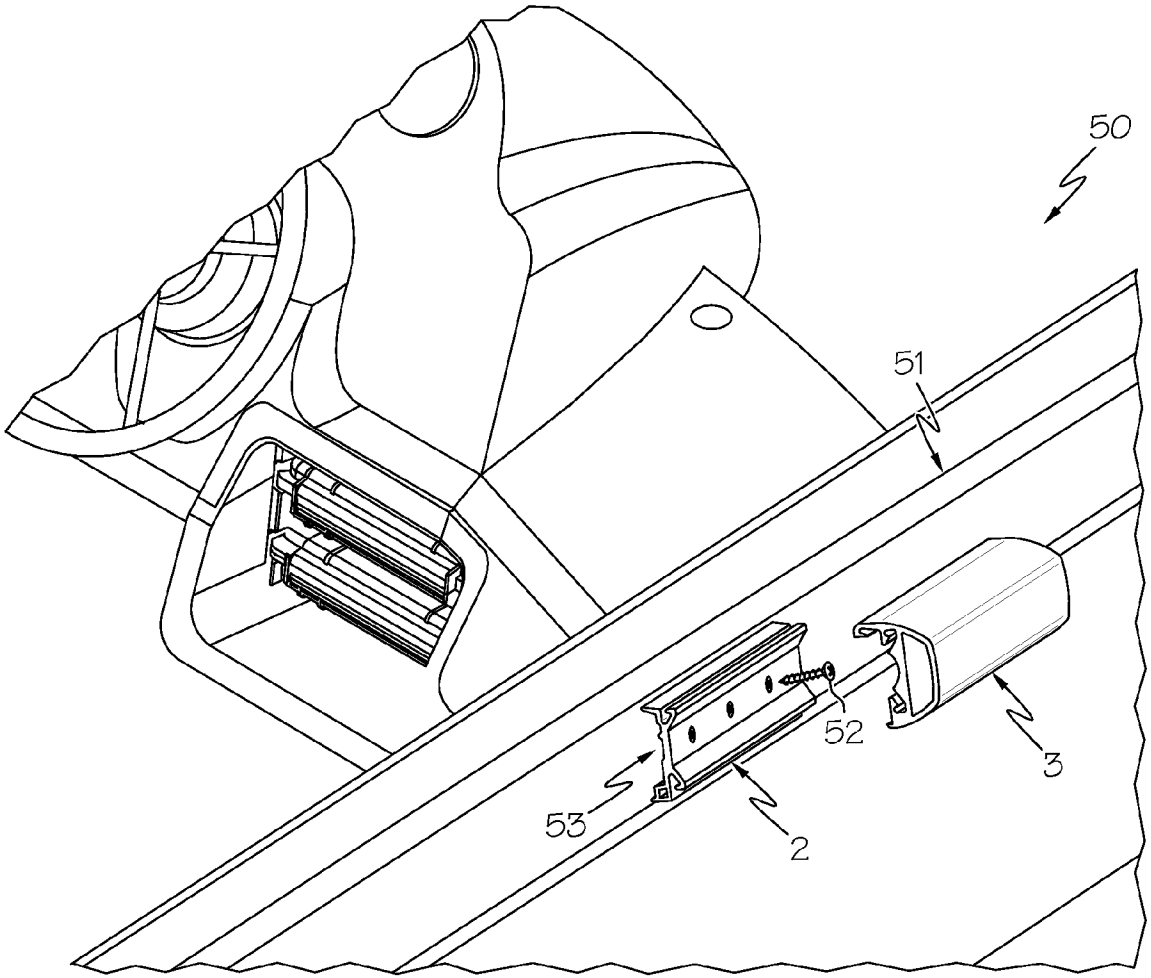
FIG. 4 is a break-away view of the rub rail system of the present invention, being fitted to the side of a vessel.
Figure 5:
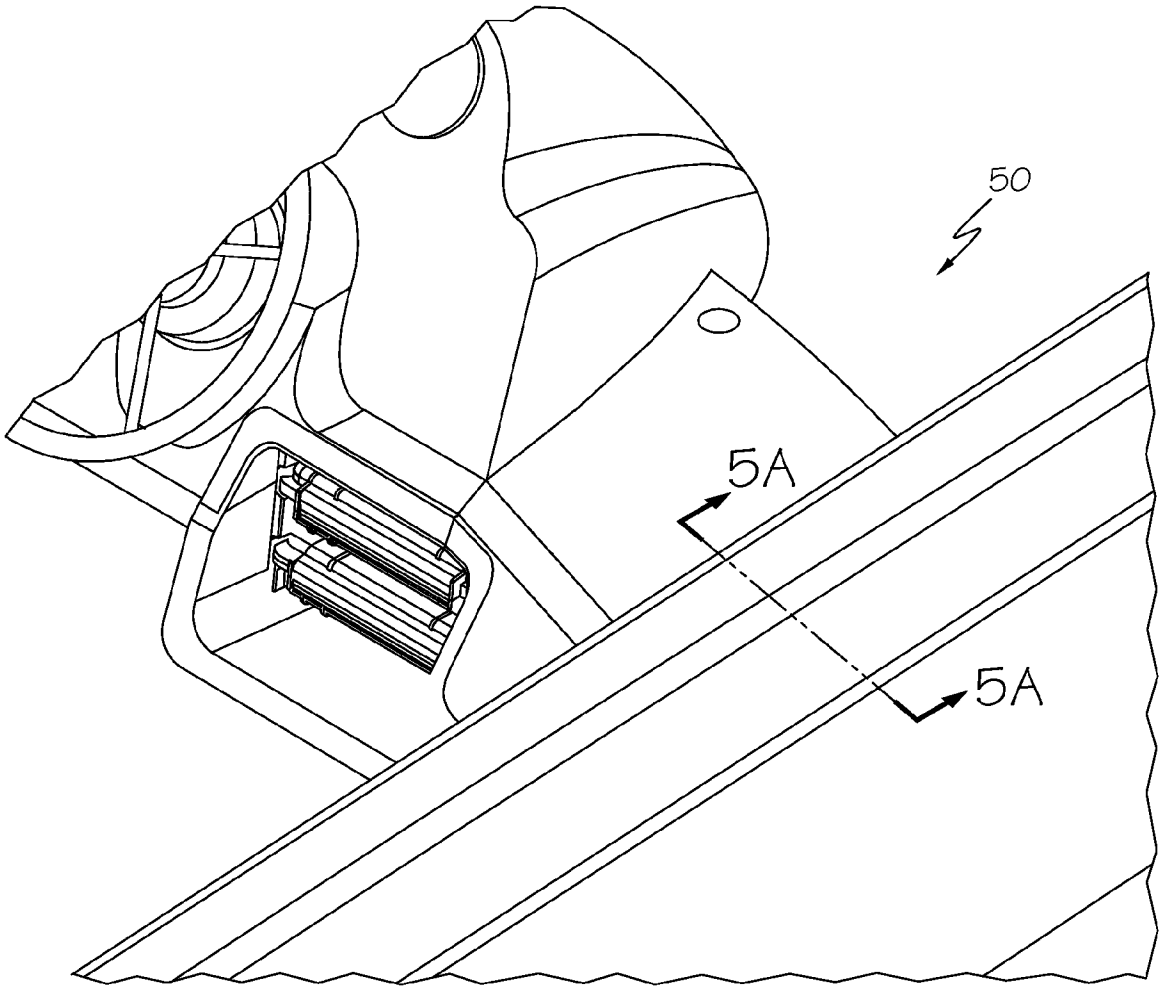
FIG. 5 is a perspective view of an exemplary vessel on which the present invention may be affixed.
Figure 5A:
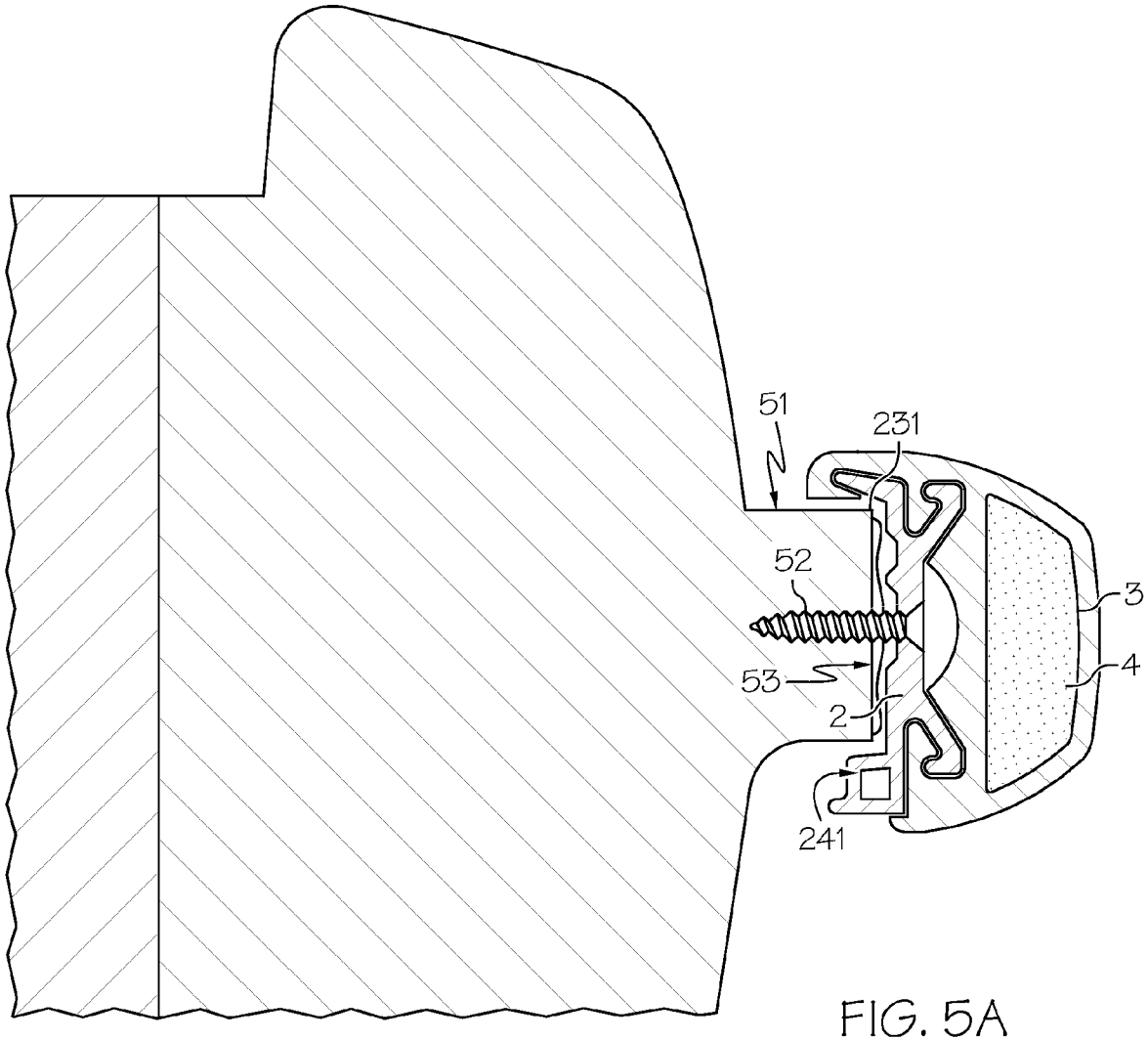
FIG. 5A is a cross-sectional view taken along line "5A" in FIG. 5, showing the rub rail system of the present invention, as fitted to the side of a vessel.

FIGS. 1, 4, and 5A depict the engagement of track 2 and fender 3. Fender 3 is designed such that it matingly engages with and is secured to track 2 without the need for external fasteners. Further, fender 3 is removeably engaged with track 2 to allow for easy repair and replacement of the fender. The upper flange 32 of fender 3 engages the upper lip 231 of track 2, with the hook-end of flange 32 fitting around the tip of the upper lip 231. Upper barb 33 engages and is received by upper receiving cavity 233 and upper tang 232 engages and is received by upper recess 36. Likewise, lower barb 35 engages and is received in lower receiving cavity 243 and lower tang 242 engages and is received by lower recess 37. In some embodiments, upper tang 232 and lower tang 242 of track 2 are designed to be slightly deformable so as to allow fender 3 to snap or slide into place. As shown, the small lower flange 34 engages and rests against the bottom of square lower lip 241.

Installation is accomplished with least resistance by first hooking flange 32 to upper lip 231, snapping upper barb 33 into upper receiving cavity 233, then rotating the fender 3 downward around track 2 such that lower barb 35 snaps into lower receiving cavity 243. This assures a tight and secure engagement that is easily repeatable across a number of segments of the rub rail. Alternatively, fender 3 may be installed by sliding upper barb 33 and lower barb 35 into upper receiving cavity 233 and lower receiving cavity 243, respectively at one end of the track 2 and providing it longitudinally into track 2 around the perimeter of the vessel. In this case, a lubricant applied between track 2 and fender 3 may be used to ease installation. Further, the removable and repeatable engagement between the track 2 and the fender 3 allows for easier repair and replacement of the system. For instance, if damage to a segment of fender 3 were to occur, but the track 2 was not damaged, the damaged fender 3 can easily be disengaged from track 2 and replaced with a new one without the need to remove fasteners or any other structural components.

With reference to FIGS. 4, 5, and 5A, track 2 is initially secured to the perimeter of the vessel 50. The specific mounting location of track 2 should not be considered limiting and it will depend on the structure characteristics of the vessel's design. However, in some embodiments, track 2 should be dimensioned such that the insides of the upper lip 231 and lower lip 241 fit snugly around the desired portion of the vessel to which the system is to be attached. For example, as shown in FIGS. 5 and 5A, the vessel 50 has a protrusion 51 extending outward from the vessel's hull, providing an ideal mounting location for track 2, with upper lip 231 snug against a top portion of the protrusion and lower lip 241 snug against a bottom portion. However, in some cases, a gap may exist between the bottom portion of the protrusion and lower lip 241, but track 2 will nevertheless remain secured. Referring back to FIG. 4, a segment of track 2 is secured to the perimeter of the vessel 50 by one or more fasteners 52 which may include screws, nails, rivets or other similar fastening means. In some embodiments, fasteners 52 are provided through the centerline of track 2. Further, in some embodiments, an adhesive sealant 53 may be applied between the vessel and track 2 providing a water lock and additional strength for the vessel/track joint.

Figure 6:
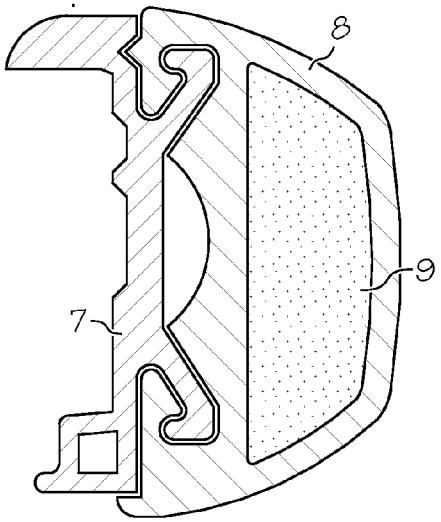
FIG. 6 is a cross-sectional view of a second embodiment of the protective rub rail system of the present invention.

With reference to FIG. 6, shown is a cross-section of another embodiment of the rub rail system of the present invention having a somewhat different configuration than that described above. As with the first embodiment, the system includes a rub rail track extrusion 7, a rub rail fender extrusion 8, and inner core 9 wherein the inner core 9 is comprised of a substantially softer material than that of extrusion 8.

Figure 7:
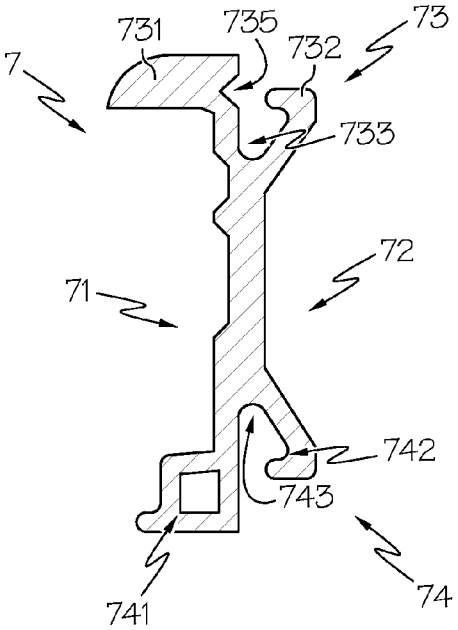
FIG. 7 is a cross-sectional view of the second embodiment the rub rail track of the present invention.

FIG. 7 is an isolated view of the cross-section of one embodiment of track 7 having a vessel side 71 and a fender side 72. Shown also is upper section 73 and a lower section 74, each having a bifurcated or two-pronged configuration. Upper section 73 includes an upper lip 731 and an upper tang 732 which delimit an upper receiving cavity 733. The upper lip 731 may also include a notch 735 on the inside of the cavity 733. In some embodiments, upper lip 731 extends rearward away from vessel side 71 and upper tang 732 extends substantially upward. Lower section 74 includes a lower lip 741, a lower tang 742 which delimit a lower receiving cavity 743. In some embodiments, lower lip 741 has a square cross-section such that, in its extruded form, the lower lip 741 is a square-tube, providing stability, strength, and rotational resistance for the bottom of track 7. Additionally, in some embodiments, lower tang 742 faces substantially downward.

Figure 8:
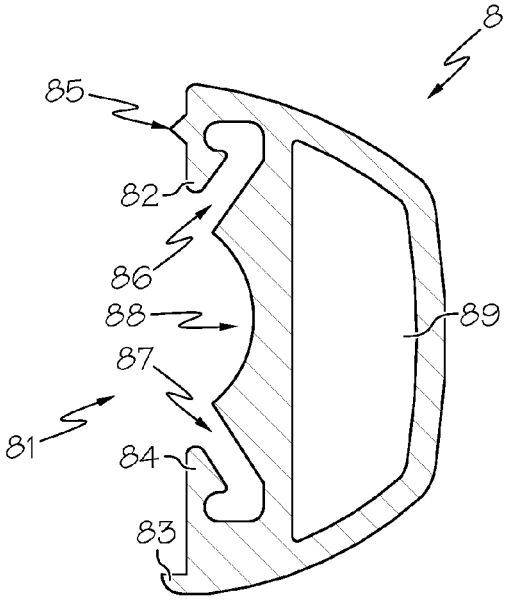
FIG. 8 is a cross-sectional view of the second embodiment the rub rail fender of the present invention.

FIG. 8 is an isolated view of the cross-section of one embodiment of fender 8. The track side 81 of fender 8 is configured to mate the fender side 72 of track 7. Fender 8 comprises an upper barb 82, a lower flange 83, and a lower barb 84. In some embodiments, upper barb 82 includes an upper groove 85 which extends rearward therefrom. Lower flange 83 defines a short protrusion extending rearward from lower barb 84. It is appreciated that, in some embodiments, the upper barb 82 extends substantially downward and the lower barb 84 extends substantially upward. Fender 8 also includes an upper recess 86 and lower recess 87, each delimited by the upper barb 82 and lower barb 84 respectively, which matingly engage track 7. Also shown is curved recess 88 and channel 89, which channel receives and is filled with inner core 9. In comparison to the embodiment shown in FIGS. 1-5A, this embodiment omits the upper flange of the fender and provides a track having a slightly truncated upper lip 731 which prevents buckling of the fender in certain circumstances and certain installations, depending on the configuration of the vessel hull and perimeter.

Figure 9:
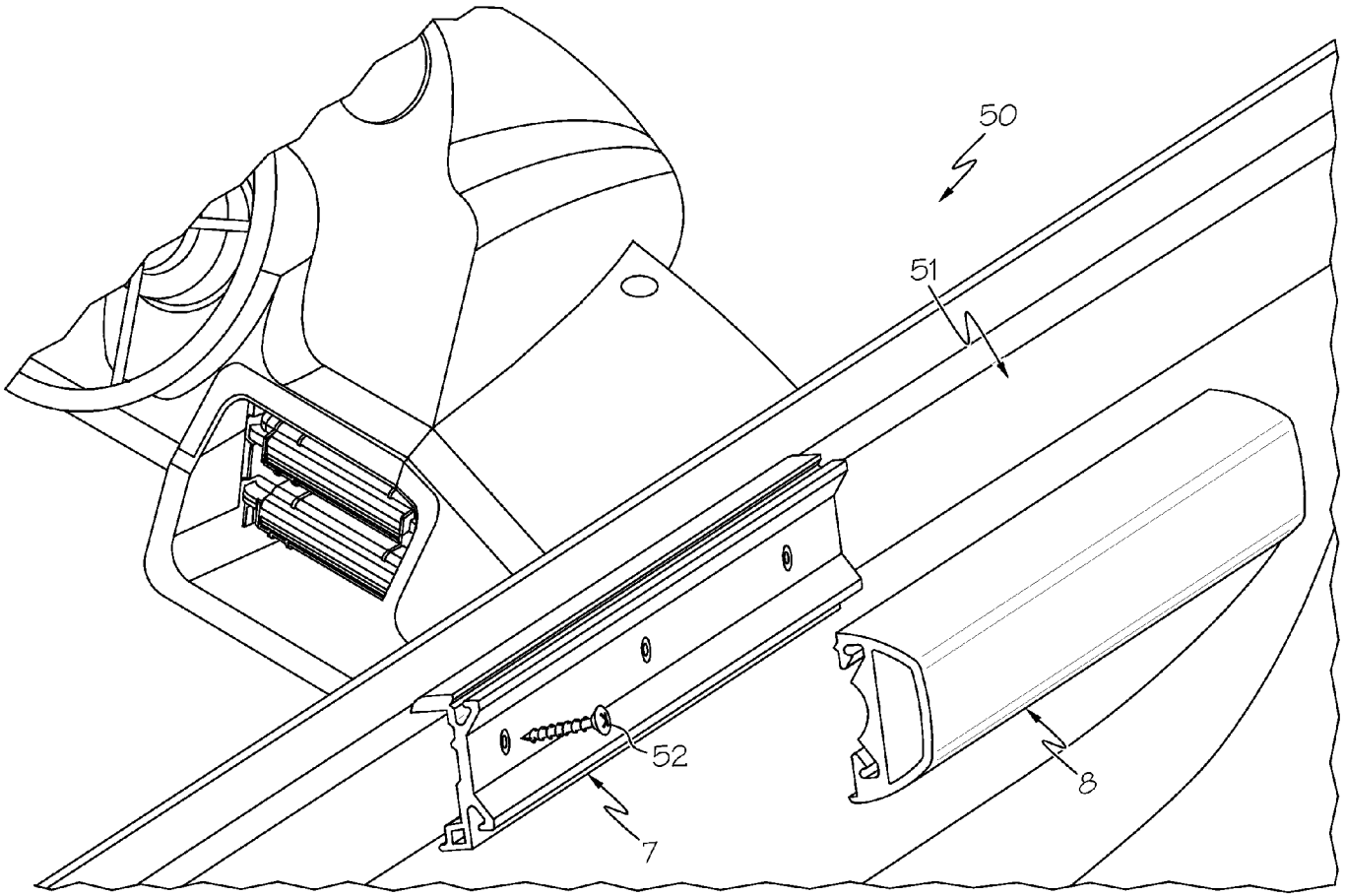
FIG. 9 is a break-away view of the second embodiment the rub rail system of the present invention, being fitted to the side of a vessel.
Figure 10:
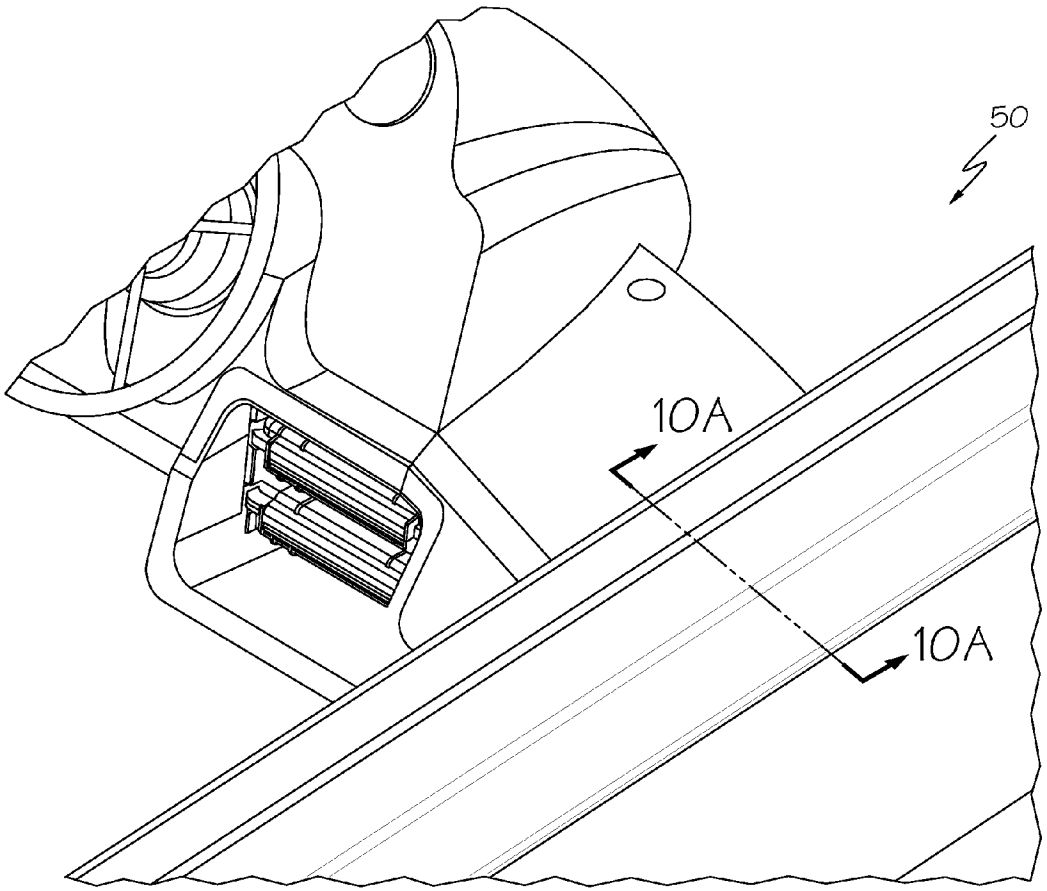
FIG. 10 is a perspective view of an exemplary vessel on which the second embodiment of present invention may be affixed.
Figure 10A:
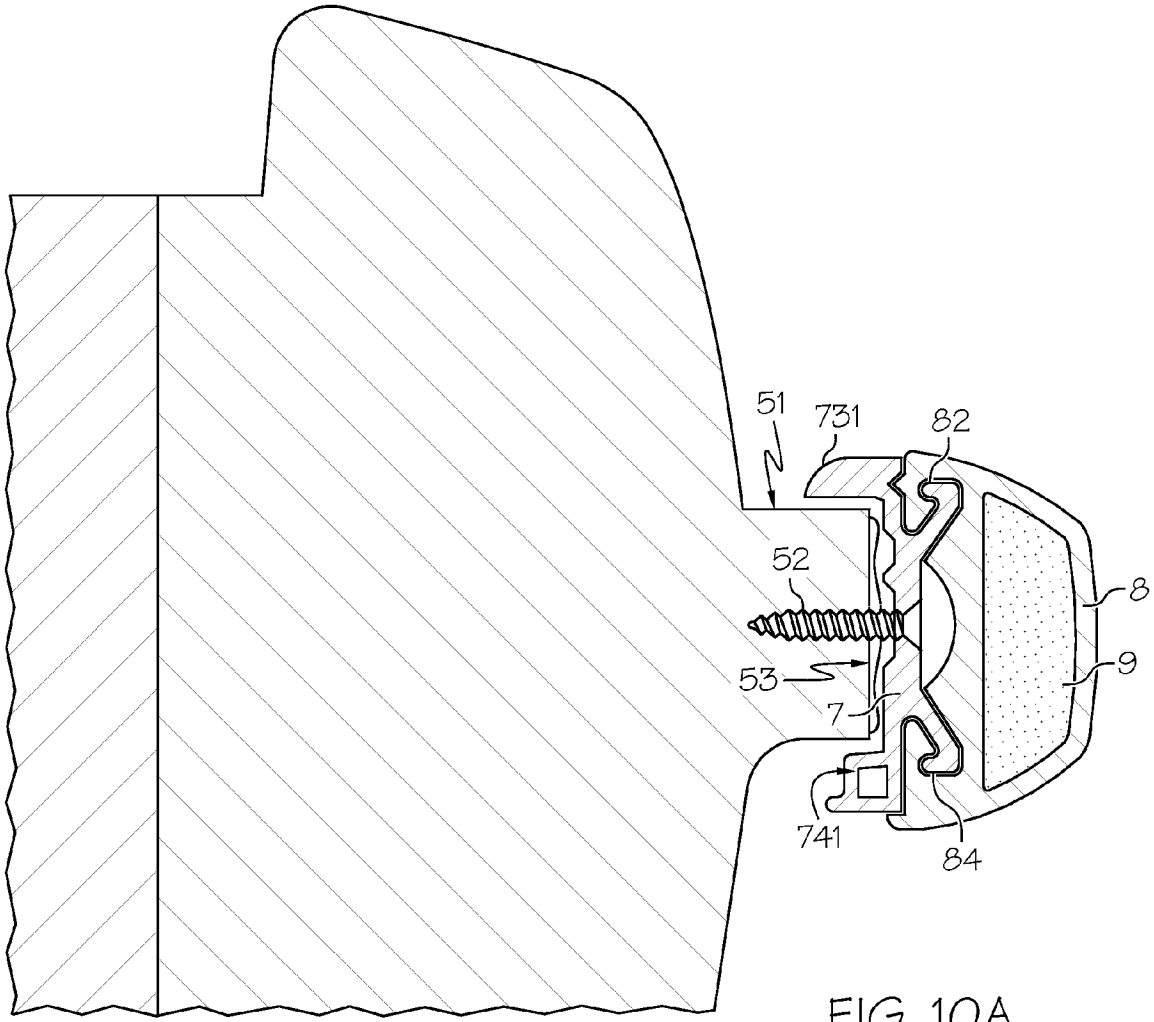
FIG. 10A is a cross-sectional view taken along line "10A" in FIG. 10, showing the second embodiment of rub rail system of the present invention, as fitted to the side of a vessel.

FIGS. 6, 9, 10, and 10A depict the engagement of track 7 and fender 8. As with the first exemplary embodiment, fender 8 is designed such that it matingly engages with and is secured to track 7 without the need for external fasteners. Further, fender 8 is removeably engaged with track 7 to allow for easy repair and replacement of the fender. The upper barb 82 of fender 8 engages and is received by upper receiving cavity 733 and upper tang 832 engages and is received by upper recess 86. Upper groove 85 engages notch 735 to provide additional stability and securement. Lower barb 84 engages and is received in lower receiving cavity 743 and lower tang 742 engages and is received by lower recess 87. In some embodiments, upper tang 732 and lower tang 742 of track 7 are designed to be slightly deformable so as to allow fender 8 to snap into place. As shown, the small lower flange 83 engages and rests against the bottom of square lower lip 741. Installation is accomplished with least resistance by snapping upper barb 82 into upper receiving cavity 733, then rotating the fender 8 downward around track 7 such that lower barb 84 snaps into lower receiving cavity 743. This assures a tight and secure engagement that is easily repeatable across a number of segments of the rub rail. Alternatively, fender 8 may be installed by sliding upper barb 82 and lower barb 84 into upper receiving cavity 733 and lower receiving cavity 743, respectively at one end of the track 7 and providing it longitudinally into track 7 around the perimeter of the vessel. With reference to FIGS. 9, 10, and 1A, track 7 is configured to engage the perimeter of a vessel 50 substantially in accordance with the description above with respect to track 2.

In operation, the rub rail system provides durable abrasion-resistant protection for the perimeter of a vessel. When a load is applied to fender 3 (or 8), the relatively hard, but flexible material will slightly deform, transforming the impact and shock to the relatively softer inner core 4 (or 9), allowing the inner core 4 (or 9) to absorb a substantial amount of the impact. In some embodiments, fender 3 (or 8) will deform or displace outwardly about curved recess 38 (or 88) as fender 3 (or 8) compresses against track 2 (or 7), which provides additional shock absorption while retaining a positive lock with track 2 (or 7). Fender 3 (or 8) is designed to be rigid enough to transfer shock to the soft core, but also resilient enough so as not to be damaged by impact, or cause damage by impact.

As noted above, track 2 (or 7) is preferably comprised of a substantially rigid material such as hardened plastic or metal. In some embodiments, track 2 (or 7) is comprised of rigid polyvinyl chloride (PVC), selected for its relatively long life in outdoor conditions. However, other rigid plastics may be used such as acrylonitrile butadiene styrene (ABS), polycarbonate, Delrin (polyoxymethylene), Nylon, Hytrel and any other rigid plastic with a hardness of at least 50 durometer on the type-D scale. Further, in some embodiments, track 2 (or 7) is comprised of a metal such as stainless steel, aluminum, and various other metal alloys known in the art. Other suitable materials can be used provided they have the required rigidity and weather resistance.

Fender 3 (or 8) and inner core 4 (or 9) are preferably comprised of a plastic material, it being appreciated that inner core 4 (or 9) is substantially softer than fender 3 (or 8). In some embodiments, fender 3 (or 8) and inner core 4 (or 9) are comprised of any of various known thermoplastic elastomers (TPE) with fender 3 (and 8) comprised of a harder and more rigid TPE than inner core 4 (or 9). TPE provides ideal weather resistance, long life, and stability over a wide temperature range. Other materials may be suitable, such as Flexible PVC, polyurethane, cell-foam materials or any other like material provided it has a hardness of between 5 and 98 durometer on the A-type scale. By way of example, in some embodiments, fender 3 (or 8) is comprised of a TPE having a Shore hardness between 75-90 A durometer and inner core 4 (or 9) has a Shore hardness between 10-20 A durometer. Further, in some embodiments, fender 3 (or 8) is comprised of a TPE having a Shore hardness of 85 A durometer and inner core 4 (or 9) has a Shore hardness of 10 A durometer. These ranges should be considered exemplary and non-limiting, however.

It is appreciated that the components of rub rail system 1 (or 6), namely track 2 (or 7) and fender 3 (or 8) can be extruded to any length desired in order to effectively protect the perimeter of any vessel, regardless of the shape and contours thereof. Additionally, it is appreciated that while the specification and drawings herein describe use of the present invention in connection with marine vessels, the system is also useful for automobiles or other vehicles where perimeter protection is desired or needed.

It is further appreciated that the rub rail system of the present invention has substantial advantages over the prior art. From a manufacturing standpoint, cast urethane fenders are much more labor intensive and require a more expensive base material. More sections are required to cover a given perimeter because the cast urethane fenders are not nearly as flexible as the instant invention. Likewise, soft hybrid collars are expensive to manufacture because they require (1) an outer skin that covers the entire collar, which is manufactured from several sections of a reinforced textile that must be cut and glued together; (2) a foam sub-core that must be hand-cut and custom fitted; (3) an inner air filled bladder that is comprised of a textile that also must be manually cut and glued. The present invention is also substantially easier to install in comparison to other systems that include a soft protective attribute. Cast urethane systems and RHIB's require gluing or integrated molding in order to provide protection, whereas the present invention can be installed like traditional rub rail system but include soft protection characteristics.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A rub rail system for a vessel, comprising:

a rigid track extrusion and a resilient flexible fender extrusion;

said resilient flexible fender extrusion completely encasing a shock absorbing inner core, wherein said inner core is substantially softer than said fender extrusion;

said track extrusion configured to attach to a perimeter of said vessel; and said fender extrusion configured to matingly engage said track extrusion.

2. The rub rail system of claim 1, said rigid track extrusion including an upper lip and a lower lip, said upper lip configured to engage a top portion of said perimeter of said vessel and said lower lip configured to engage a lower portion of said perimeter of said vessel.

3. The rub rail system of claim 2, wherein said lower lip has a square cross-section.

4. The rub rail system of claim 2, said fender extrusion including an upper flange and a lower flange, wherein said upper flange engages said upper lip of said track extrusion and said lower flange engages said lower lip of said track extrusion.

5. The rub rail system of claim 4, wherein said upper flange includes a hook-shaped end that engages a tip of said upper lip of said track extrusion.

6. The rub rail system of claim 4, wherein said upper flange is longer than said lower flange.

7. The rub rail system of claim 2, said fender extrusion including an upper barb and a lower barb, said upper barb engaging an upper receiving cavity of said track extrusion and said lower barb engaging a lower receiving cavity of said track extrusion.

8. The rub rail system of claim 7, said track including having an upper tang and a lower tang, said upper tang engaging an upper recess of said fender extrusion and said lower tang engaging a lower recess of said fender extrusion.

9. The rub rail system of claim 7, said fender extrusion including a lower flange, wherein said lower flange engages said lower lip of said track extrusion.

10. The rub rail system of claim 7, said upper barb of said fender extrusion including a groove, wherein said groove engages a notch in said upper receiving cavity of said track extrusion.

11. The rub rail system of claim 1, wherein said rigid track extrusion is comprised of a plastic having a hardness of at least 50 durometer on the D-type scale.

12. The rub rail system of claim 11 wherein said plastic comprises polyvinyl chloride.

13. The rub rail system of claim 1, wherein said fender extrusion and said inner core are comprised of thermoplastic elastomer having a hardness between 5 and 98 durometer on the A-type scale, said inner core having a lower hardness than said fender extrusion.

14. The rub rail system of claim 1, wherein one or more fasteners are provided through said track extrusion to attach said track extrusion to said perimeter of said vessel.

15. The rub rail system of claim 1, wherein said fender extrusion includes a curved recess configured to compress against said track extrusion.

* * * * *